US007699064B2

(12) United States Patent
Schlief et al.

(10) Patent No.: US 7,699,064 B2
(45) Date of Patent: Apr. 20, 2010

(54) DISHWASHER MACHINE

(75) Inventors: Martin Schlief, Werther (DE); Volker Stank, Hiddenhausen (DE); Markus Thulig, Beckum (DE)

(73) Assignee: Miele & Cie. KG, Gutersloh (DE)

( * ) Notice: Subject to any disclaimer, the term of this patent is extended or adjusted under 35 U.S.C. 154(b) by 43 days.

(21) Appl. No.: 11/579,969

(22) PCT Filed: Apr. 27, 2005

(86) PCT No.: PCT/EP2005/004499

§ 371 (c)(1),
(2), (4) Date: Nov. 10, 2006

(87) PCT Pub. No.: WO2005/112730

PCT Pub. Date: Dec. 1, 2005

(65) Prior Publication Data

US 2007/0240744 A1 Oct. 18, 2007

(30) Foreign Application Priority Data

May 10, 2004 (DE) ..... 10 2004 023 509

(51) Int. Cl.
*B08B 3/04* (2006.01)

(52) U.S. Cl. ..... 134/104.4

(58) Field of Classification Search ..... 134/104.4
See application file for complete search history.

(56) References Cited

U.S. PATENT DOCUMENTS 2,879,026 A * 3/1959 Meeker et al. ..... 251/291
3,049,114 A * 8/1962 Carnahan et al. ..... 126/191
3,190,709 A * 6/1965 Dutcher et al. ..... 312/228
3,750,989 A * 8/1973 Bergeson ..... 248/650
3,906,967 A * 9/1975 Bergeson ..... 134/104.4
5,040,758 A * 8/1991 Giovannetti ..... 248/188.4
5,980,006 A * 11/1999 Wilhelmstatter et al. . 312/319.1

FOREIGN PATENT DOCUMENTS

EP 0243632 * 11/1987

OTHER PUBLICATIONS

Machine translation of EP 0243632.*
Machine translation of EP 0243632—(Nov. 1987).*

* cited by examiner

*Primary Examiner*—Frankie L Stinson
*Assistant Examiner*—Samuel A Waldbaum

(57) ABSTRACT

The invention relates to a dishwasher having a rinsing container (1) which is sealable on its front side by an appliance door that is pivotable on its bottom section about a horizontal axis, whereby a base area (3) that extends beneath the rinsing container (1) is bordered at the bottom by collecting dish (32), at the rear by a cover (2) and at the front by a connecting strip (10), having appliance feet (13, 14) that are adjustable in height and having an adjustment device for varying the closing behavior of the appliance door. To design the entire base area (3) so that it is easy to assembly and nevertheless is readily accessible, it is proposed that the lateral borders of the base area (3) shall be formed by two base parts (11, 12), each of which is attached as a narrow receptacle housing for the appliance feet (13, 14), their height adjustment and the adjustment device and each of which is attached to the cover (2) and to the connecting strip (10).

20 Claims, 3 Drawing Sheets

DISHWASHER MACHINE

FIELD OF THE INVENTION

The present invention relates to a dishwashing machine having a rinsing container that is closable on its front side by an appliance door on its bottom section that is pivotable about a horizontal axis, whereby a base area extends beneath the rinsing container, bordered at the bottom by a collecting dish, at the rear by a cover and at the front by a connecting strip, with appliance feet that are adjustable in height and width and an adjusting device for varying the closing behavior of the appliance door.

BACKGROUND OF THE INVENTION

A dishwashing machine as described above is manufactured and distributed by the applicant under the model number G 892-4 SCi PLUS. With this dishwashing machine, both the appliance feet and the components of the adjusting device are mounted individually on the appliance housing and/or on the rinsing container. This results in an expensive design comprised of many individual parts and therefore also a high assembly cost.

EP 0 243 632 B1 also discloses a dishwashing machine in which the base is formed by an assembly pan made of plastic that is closed on all sides and holds the appliance units (pumps, . . . ) that are below the rinsing container. It is very difficult to perform repair work in the area of the base. For such repairs, it is usually necessary to dismantle and the dishwashing machine and turn it upside down. To gain access to the components in the area of the base, all parts mounted on the mounting pan in this machine and at the same time connected to the rinsing container in any way would have to be released to be able to remove the pan. The subsequent assembly is also difficult because then the parts that have been released must be reassembled with the assembly pan without visual contact.

SUMMARY OF THE INVENTION

The present invention is thus based on the problem of providing a dishwashing machine of the type defined in the preamble in which the entire base area is constructed easily, i.e., in a manner that is easy to assemble and nevertheless easily accessible.

According to this invention, this problem is solved by a dishwashing machine having the features of claim 1. Advantageous embodiments and refinements of the invention are derived from the following dependent claims.

The advantages that can be achieved with the invention result from the multifunctionality of the base parts, whereby a compact design is achieved while avoiding a bulky design.

The two parts may easily be prefabricated as a modular group and then simply mounted on the components (cover and connecting strip) that are already present.

BRIEF DESCRIPTION OF THE DRAWINGS

An exemplary embodiment of the invention is illustrated purely schematically in the drawings and described in greater detail below.

DETAILED DESCRIPTION OF THE INVENTION

Figure 1:
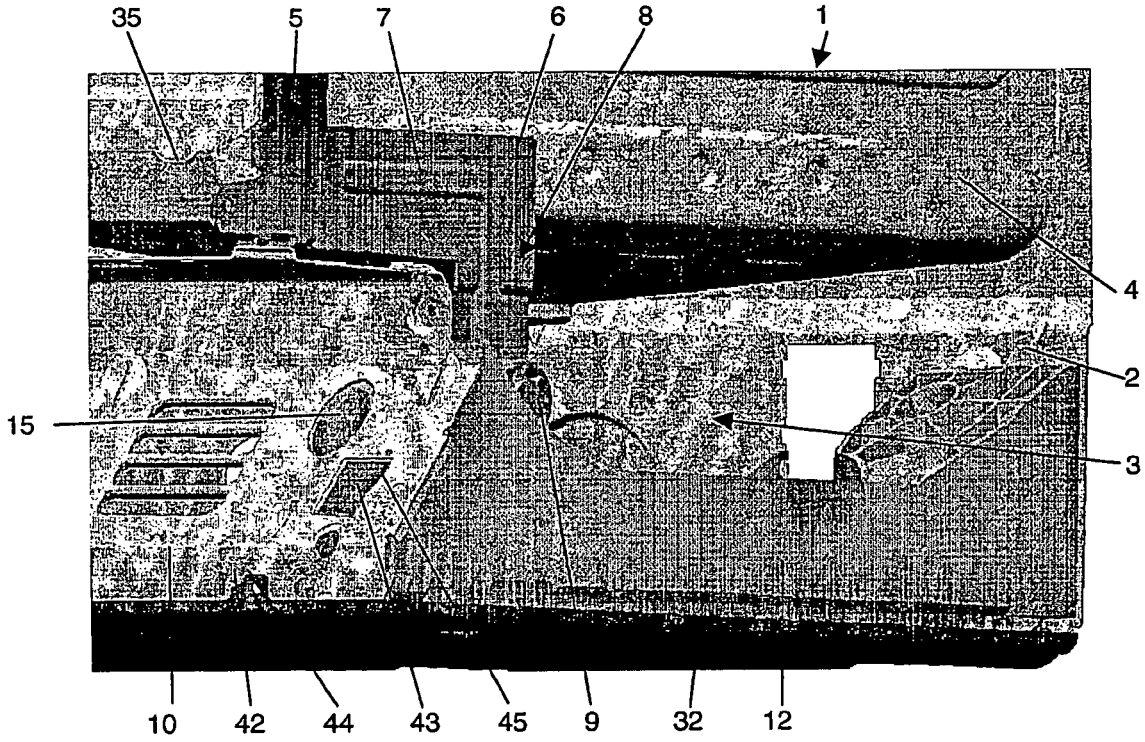
FIG. 1 shows a perspective front view of the base area 3 of a dishwashing machine designed according to this invention.

In the dishwashing machine shown in FIG. 1, the appliance parts such as pumps, water softener block, etc. which are normally present in the base area have been omitted to simplify the illustration of the parts essential to the invention. The side walls and door are also removed. The situation is the same in FIG. 2. The rinsing container has again been omitted in FIG. 3 to give an unobstructed view from above.

Figure 2:
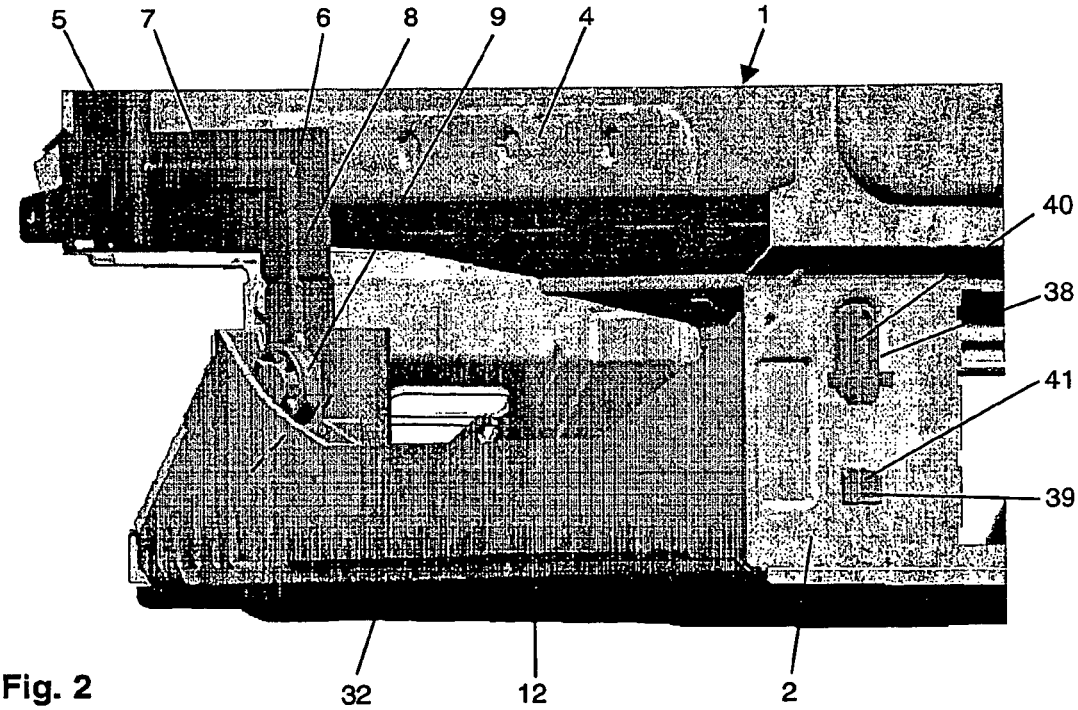
FIG. 2 shows a perspective rear view of the base area 3.
Figure 3:
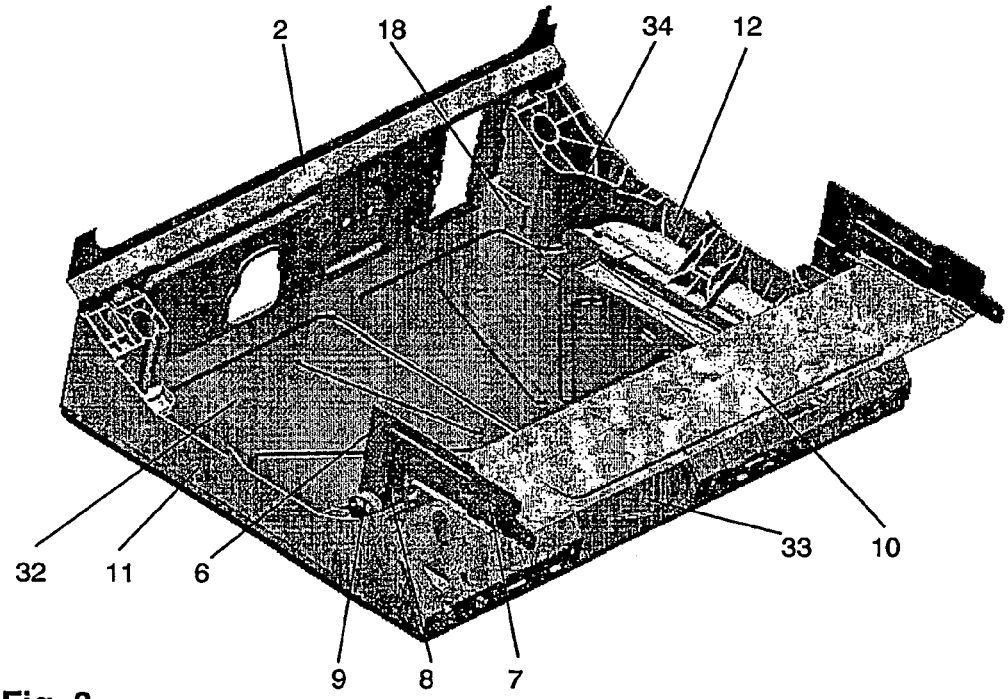
FIG. 3 shows a perspective view of the base area 3 from above with the rinsing container 1 removed.

The dishwashing machine illustrated in FIGS. 1 through 3 has a rinsing container 1 with a metal plate 2 welded to the back side as a back cover. This metal plate 2 borders the base area 3 below the rinsing container 1 toward the rear. A base strip 5 is attached to both side walls 4 of the rinsing container 1 again by welding, but only the lower area of the right strip 5 is shown in FIGS. 1 and 2. The lower ends of the base strips 5 are connected to right-angle connections 6 by clinches. The horizontal legs 7 of the supports 6 serve to pivotably mount the appliance door, while the vertical legs 8 support a first roller 9 in a stationary mount. In addition, a metal plate having multiple angles is attached to the supports 6, forming the so-called connecting strip 10 which closes the base area 3 at the front. In the case of integratable dishwashers which are installed under a kitchen countertop, the connecting strip 10 remains unpaneled because it will be covered by a continuous cabinetry kick strip running in front of the feet of the kitchen appliances. In the case of free-standing appliances or under-counter appliances installed in the kitchen line, the connecting strip 10 is paneled by suitable base strips (not shown).

Figure 4:
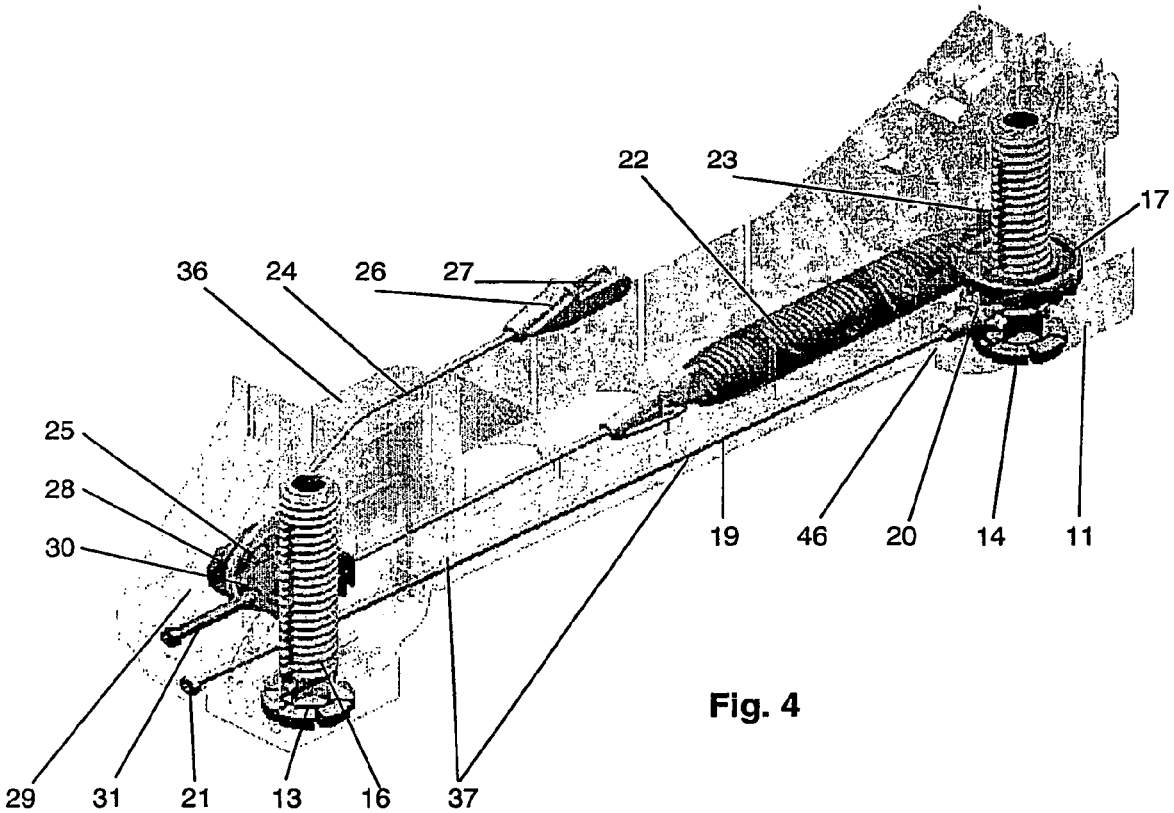
FIG. 4 shows a base part as a detail with raised feet, showing the foot height adjustment and adjusting device of the door equalization.
Figure 5:
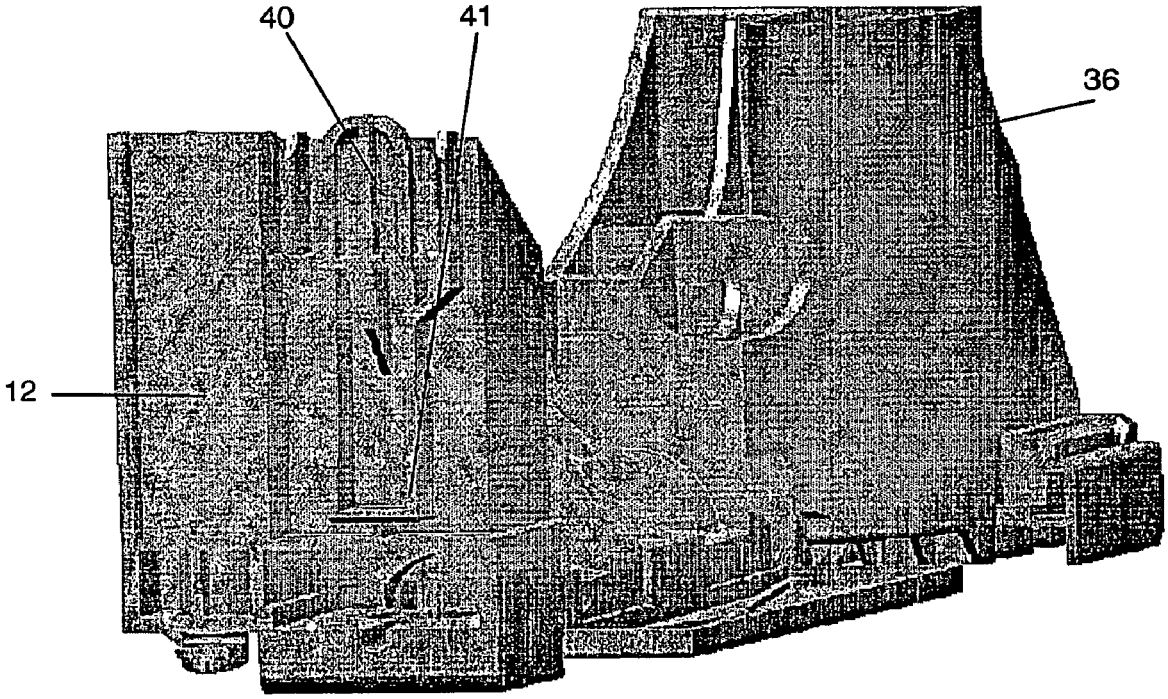
FIG. 5 shows an isometric view of a base part from the rear.

Between the connecting strip 10 and the rear cover 2, there is a base part 11 and 12 extending on each side, whereby both parts 11 and 12 are designed to be at least approximately symmetrical. FIG. 4 shows the left base part 11 in a perspective view, whereby individual components on the inside, which are normally covered, have been emphasized. FIG. 5 shows an isometric view of the right base part 12 from the rear. Base parts 11 and 12 are each designed as narrow receptacle housings. They are manufactured by injection molding of plastic and each functions as a multifunctional modular group. Each base part holds one front appliance foot 13 and one rear appliance foot 14. For adjusting the height of the front appliance foot 13, a cylindrical receptacle shaft 15 having an inside thread (not shown) is provided. It cooperates with the outside thread 16 on the shaft of the foot. The height adjustment of the rear appliance foot is performed by means of a crown gear 17 which is rotatably mounted in a receptacle chamber 18. The crown gear 17 is rotated via an adjusting rod 19 which has a pinion 20 engaging in the crown gear 17 at one end and an adjusting device in the form of a screw head 21 at the other end. The entire adjusting system is arranged on the base parts 11 and 12 and is therefore prefabricated before their installation in the dishwashing machine.

The same thing also applies to the adjusting devices for the door equalization. To assist the user in closing the appliance door, a large portion of the closing force required to move the door is applied by a spring mechanism. This mechanism must be adjusted precisely for the weight of the door. In the case of the integratable dishwashers, the outer door metal plate is lined with a front panel that fits with the other appliances and cabinets in the kitchen cabinetry. Since such front panels are of various weights, presetting of the spring mechanism at the factory is necessarily inaccurate. The precise adjustment of the closing force required for pivoting the door can be performed only by the user using an adjustment device that prestresses a helical spring 22 to variable extents. To this end, the spring 22 is suspended on a journal 23 at one end. The other end is connected to a tension cable 24 which is guided via a second roller 25 and carries an eyelet 26 on its other end. Hooks 27 are arranged on the base parts 11 and 12 with the eyelets 26 suspended in the hooks as preparation for the assembly process in a parked position. After installation of the base parts 11 and 12 as described below, the eyelets 26 are then removed from the hooks 27, the cable 24 is guided over the first rollers 9 on the support 6 and suspended in the rear area of the door in hooks (not shown). To adjust the spring force, the axle of the second roller 25 is mounted in a sliding block 28 which sits in a longitudinal guide 29 on the base part 11, 12. In the sliding block 28, a bore 30 is arranged with a thread (not shown) into which a screw 31 is screwed. The end of the screw 31 is supported on the rear end wall of the longitudinal guide 29 so that the sliding block 28 is moved in the direction of the connecting plate 10 by the screw 31 emerging on the rear side. In doing so, the sliding block applies tension to the cable 24, which is guided over the second roller 25 and thus the spring 22.

The base area 2 of the dishwasher is bordered at the bottom by a collecting dish 32 (see FIG. 3) which serves to collect any water that might escape from the rinsing container 1 and diverted into a recessed area 33 above which a float switch (not shown) is located. The dish 32 is bolted at the corners to the two base parts 11 and 12 via a mounting dome 34 with additional mounting at the front on the lower edge of the connecting strip 10. For better management of the liquid escaping from the rinsing container 1, the latter is equipped with a deep overflow 35 (see FIG. 1) at this point, from which the liquid is diverted over the connecting strip 10 into a drain channel 36 (see FIGS. 4 and 5) that is integrally molded on the base part 11, 12 and into the recessed area 33.

Assembly of the base strips 11 and 12 is accomplished with the rinsing container 1 upside down. Before installation of these strips, the appliance feet 13 and 14 are screwed on and the adjusting rod 19 with the pinions 20 are inserted into guides 46 and retaining noses 37 (see FIG. 4) provided for this purpose. Furthermore, the spring 22, the tension cable 24 and the second roller 25 are premounted. The eyelet 26 is in its parked position on the hook 27. In the area of the rear cover, the base strips 11 and 12 are attached by a catch connection. To this end, two cutouts 38 and 39 situated one above the other are punched out of the sheet metal of the cover 2 on each side. The upper cutout 38 holds a catch nose 40 which is inserted from above into its installed position by pivoting the front area of the base part 11, 12. A stabilizing dome 41 is pressed into the lower cutout. At the front, the base parts 11 and 12 are screwed into the supports 6 through the connecting strip 10 (not shown). Then the collecting pan 32 is bolted into position on the base. For assembly of the pedestal base and/or the substructure, insertion channels 42 and 43 are provided on the base parts, holding the mounting domes of the base (not shown) in a form-fitting manner. The connecting strip is provided with the corresponding passages 44 and 45 to this end.

The invention claimed is:

1. A dishwasher having a rinsing container which can be sealed on its front side by an appliance door that is pivotable about a horizontal axis on the bottom section thereof, said dishwasher comprising:

(a) a base area which extends beneath the rinsing container and is bordered at the bottom by a collecting pan, at the rear by a cover, at the front by a connecting strip, and at each of the two sides by a base part;

(b) appliance feet that are adjustable in height and engaged with a base part; and (c) an adjustment device for varying the closing behavior of the appliance door and contained in a base part, the adjustment device comprising:

(c1) a spring that may be adjustably stressed by manipulation of the adjustment device, (c2) a tension cable engaged at one end with the spring and at the other end with the door, and (c3) a roller mounted in a sliding block engaged with a longitudinal guide, the sliding block having a threaded bore for engagement with a screw, and the tension cable being guided over the roller, wherein rotation of the screw causes the sliding block to move along the longitudinal guide, thereby causing the roller mechanism to move along the tension cable to adjust the stress on the spring;

wherein each base part is designed as a narrow receptacle housing for the appliance feet and height adjustment thereof and the adjustment device, each base part being mounted between the cover and the connecting strip.

2. A dishwasher according to claim 1, wherein each base part is manufactured in one piece as an injection-molded plastic part.

3. A dishwasher according to claim 2, wherein each base part can be mounted on the cover by means of a catch connection.

4. A dishwasher according to claim 3 further comprising a guiding device for guiding liquid out of an overflow of the rinsing container into a collecting dish.

5. A dishwasher according to claim 3, wherein each base part comprises an insertion channel for form-fitting mounting of the base part in the base area.

6. A dishwasher according to claim 2 further comprising a guiding device for guiding liquid out of an overflow of the rinsing container into a collecting dish.

7. A dishwasher according to claim 2, wherein each base part comprises an insertion channel for form-fitting mounting of the base part in the base area.

8. A dishwasher according to claim 1, wherein each base part can be mounted on the cover by means of a catch connection.

9. A dishwasher according to claim 8 further comprising a guiding device for guiding liquid out of an overflow of the rinsing container into a collecting dish.

10. A dishwasher according to claim 8, wherein each base part comprises an insertion channel for form-fitting mounting of the base part in the base area.

11. A dishwasher according to claim 1 further comprising a guiding device for guiding liquid out of an overflow of the rinsing container into the collecting pan.

12. A dishwasher according to claim 11, wherein each base part comprises an insertion channel for form-fitting mounting of the base part in the base area.

13. A dishwasher according to claim 1, wherein each base part comprises an insertion channel for form-fitting mounting of the base part in the base area.

14. A dishwasher according to claim 1, wherein the height adjustment of one or more appliance feet comprises a cylindrical receptacle shaft having an inside thread in the base area and an outside-threaded shaft of the appliance feet, wherein the outside thread of the appliance feet is complementary to the inside thread of the receptacle shaft.

15. A dishwasher according to claim 1, wherein the height adjustment of one or more appliance feet comprises a crown gear rotatably mounted in the base area and an outside-threaded shaft of the appliance feet, wherein the outside thread of the appliance feet is complementary to the crown gear.

16. A dishwasher according to claim 1, wherein each base part housing an adjustment device comprises a hook.

17. A dishwasher according to claim 16, wherein the door comprises one or more hooks corresponding to the hook on each base part.

18. A dishwasher according to claim 1, wherein the tension cable further comprises an eyelet suitable for removable engagement with a hook on a base part or the door.

19. A dishwasher according to claim 18, wherein prior to installation of a base part housing an adjustment device the tension cable eyelet is engaged with a base part hook and subsequent to installation of the base part the eyelet is engaged with a door hook.

20. A dishwasher having a rinsing container which can be sealed on its front side by an appliance door that is pivotable about a horizontal axis on the bottom section thereof, said dishwasher comprising:

(a) a base area which extends beneath the rinsing container and is bordered at the bottom by a collecting pan, at the rear by a cover, at the front by a connecting strip, and at each of the two sides by a base part;

(b) appliance feet that are adjustable in height and engaged with a base part, wherein the appliance feet comprise an outside-threaded shaft and the base area comprises one or more cylindrical receptacle shafts being threaded complementarily to the outside-threaded shaft of the appliance feet and one or more crown gears being threaded complementarily to the outside-threaded shaft of the appliance feet; and (c) an adjustment device for varying the closing behavior of the appliance door and contained in a base part, the adjustment device comprising (i) a spring that may be adjustably stressed by manipulation of the adjustment device, (ii) a tension cable engaged at one end with the spring and at the other end with the door, (iii) a roller mounted in a sliding block engaged with a longitudinal guide, the sliding block having a threaded bore for engagement with a screw, and the tension cable being guided over the roller, wherein rotation of the screw causes the sliding block to move along the longitudinal guide, thereby causing the roller mechanism to move along the tension cable to adjust the stress on the spring, and wherein each base part is designed as a narrow receptacle housing for the appliance feet and height adjustment thereof and the adjustment device, each base part being mounted between the cover and the connecting strip.

* * * * *